US006851345B1

(12) United States Patent
Kennelly et al.

(10) Patent No.: US 6,851,345 B1
(45) Date of Patent: Feb. 8, 2005

(54) CUTTING TABLE FENCE

(75) Inventors: John P. Kennelly, P.O. Box 2541, Lake Almanor, CA (US) 96137; Jack A. Linn, Lake Almanor, CA (US)

(73) Assignee: John P. Kennelly, Lake Almanor, CA (US)

( * ) Notice: Subject to any disclaimer, the term of this patent is extended or adjusted under 35 U.S.C. 154(b) by 0 days.

(21) Appl. No.: 09/109,830

(22) Filed: Jul. 2, 1998

(51) Int. Cl.[7] ..... B25H 1/02; B27B 31/00

(52) U.S. Cl. ..... 83/438; 83/468.7; 83/477.2; 33/443; 144/253.5

(58) Field of Search ..... 83/438, 477.2, 83/444, 446, 423, 468.2, 468.7, 207, 268; 269/304, 303, 315; 144/253.1, 253.2, 253.5; 33/443, 444; 198/731

(56) References Cited

U.S. PATENT DOCUMENTS

| | | | | | |
|---|---|---|---|---|---|
| 99,759 | A | * | 2/1870 | Child | 144/253.1 X |
| 345,758 | A | * | 7/1886 | Barnes | 83/438 X |
| 2,129,457 | A | * | 9/1938 | Von Zimmerman | 33/443 X |
| 2,805,479 | A | | 9/1957 | Droste | 33/444 |
| 4,516,612 | A | * | 5/1985 | Wiley | 83/438 X |
| 4,521,006 | A | | 6/1985 | Waters | 269/304 |
| 5,954,106 | A | * | 9/1999 | Huang | 83/438 X |

FOREIGN PATENT DOCUMENTS

| | | | | |
|---|---|---|---|---|
| DE | 38 35 369 | * | 5/1989 | 198/731 |
| DE | 38 28 712 | * | 3/1990 | 198/731 |
| GB | 2 232 650 | * | 12/1990 | 198/731 |
| SU | 986836 | * | 7/1983 | 198/731 |

OTHER PUBLICATIONS

*Better Homes and Gardens Wood Magazine*, "Rip Fences—What you need to know before upgrading", Feb. 1997, Issue No. 95, pp. 54–58.

* cited by examiner

*Primary Examiner*—Clark F. Dexter
(74) *Attorney, Agent, or Firm*—Wells St. John P.S.

(57) ABSTRACT

A fence is described for attachment to a cutting table or in combination with a cutting table. The fence includes pair of elongated guide rails with brackets configured to be mounted to the cutting table. An endless chain is provided on each guide rail, trained about sprockets rotatably mounted on the guide rail. Each chain includes a working flight that extends along the associated guide rail. Each chain further includes sprocket tooth receiving spaces. A shaft interconnects, one of the sprockets on one guide rail with one of the sprockets on the remaining guide rail such that rotation of the shaft will result in all the sprockets rotating in unison, causing uniform and equal movement of the chain. An elongated cutting guide is provided with aligning lugs that are releasably received within selected tooth receiving spaces of the chains in such a manner that the cutting guide may be selectively engaged with the chains and lifted from the chains. A locking mechanism is configured to secure the cutting guide in a selected position along the working flights of the chains.

21 Claims, 7 Drawing Sheets

CUTTING TABLE FENCE

TECHNICAL FIELD

The present invention relates to cutting guides in general and more particularly to a removable fence for a cutting table.

BACKGROUND OF THE INVENTION

Numerous fence designs have been produced for the cutting tables of various cutting tools such as woodworking table saws. The fence on a table saw is used, in general, to hold an edge of a workpiece at a specific angle, usually parallel to a cutting blade 13. The fence must be held parallel to the blade to minimize the kerf width, and to avoid dangerous "kick-back." A precisely parallel fence also is a significant factor in cutting accuracy.

Much of recent development in design of fences for cutting tables has focused on accuracy, or the ability for the fence to maintain an accurate state of parallelism with the saw blade. However, a high degree of accuracy has not been maintained, at least not without involving complex and difficult to install mechanisms. Such mechanisms most often result in a practically permanent installation of the fence on the saw, since removal and remounting of the fence is most often a laborious, time consuming chore.

An example of a high quality, accurate retrofit fence for table saws is described in U.S. Pat. No. 4,521,006 to Waters. This fence makes use of pulley mounted cables that extend in an endless loop along opposite sides and across one end of the saw table. Two flights of the cable run parallel to each of the front and back edges of the table. Two of the four flights move in the same direction as the cable is moved about the pulleys. Blocks are secured to these parts of the cable. The blocks are releasably mounted to locking devices provided at opposite ends of the fence cutting guide. Two clamping levers are used to secure the fence to "L" shaped brackets that are bolted to the table. In order to remove the fence from the table, the blocks must be moved laterally toward the table, away from engagement with the locking levers. This requires the user to reach under the fence, shift one block from engagement with the associated locking lever, then walk around the saw and perform the same steps to remove the remaining block from the lever on that side of the table. Now the fence may be removed, but only by sliding it off an end of the table. Remounting the fence involves the above operation in reverse.

U.S. Pat. No. 2,805,479 to Droste discloses a work table for sheet materials in which opposite ends of a fence-like bar are mounted to cables that extend about pairs of pulleys. The pulleys are rotatably mounted at ends of the table. Two of the pulleys are interconnected by a drive shaft for rotation in unison. Thus rotation of the shaft will cause corresponding substantially equal motion of the cables about the pulleys. The fence spans the table, with ends clamped to the cables by screw and nut combinations. The fence may be removed by loosening the clamps.

The above examples of cable and pulley mounted fences operate well to hold a fence in accurate position on across a table surface, but both are relatively complex. Also neither of the above apparatus are easily removable from the cutting table when use requires removal of the fence.

It is therefor an object of the present invention to provide a cutting table fence that is simple in construction, easy to mount to an existing cutting table, and which includes a cutting guide that is easily removable from the table.

The above and still further objects and advantages will become apparent from the following description which, taken with the accompanying drawings, disclose a preferred form of the present invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
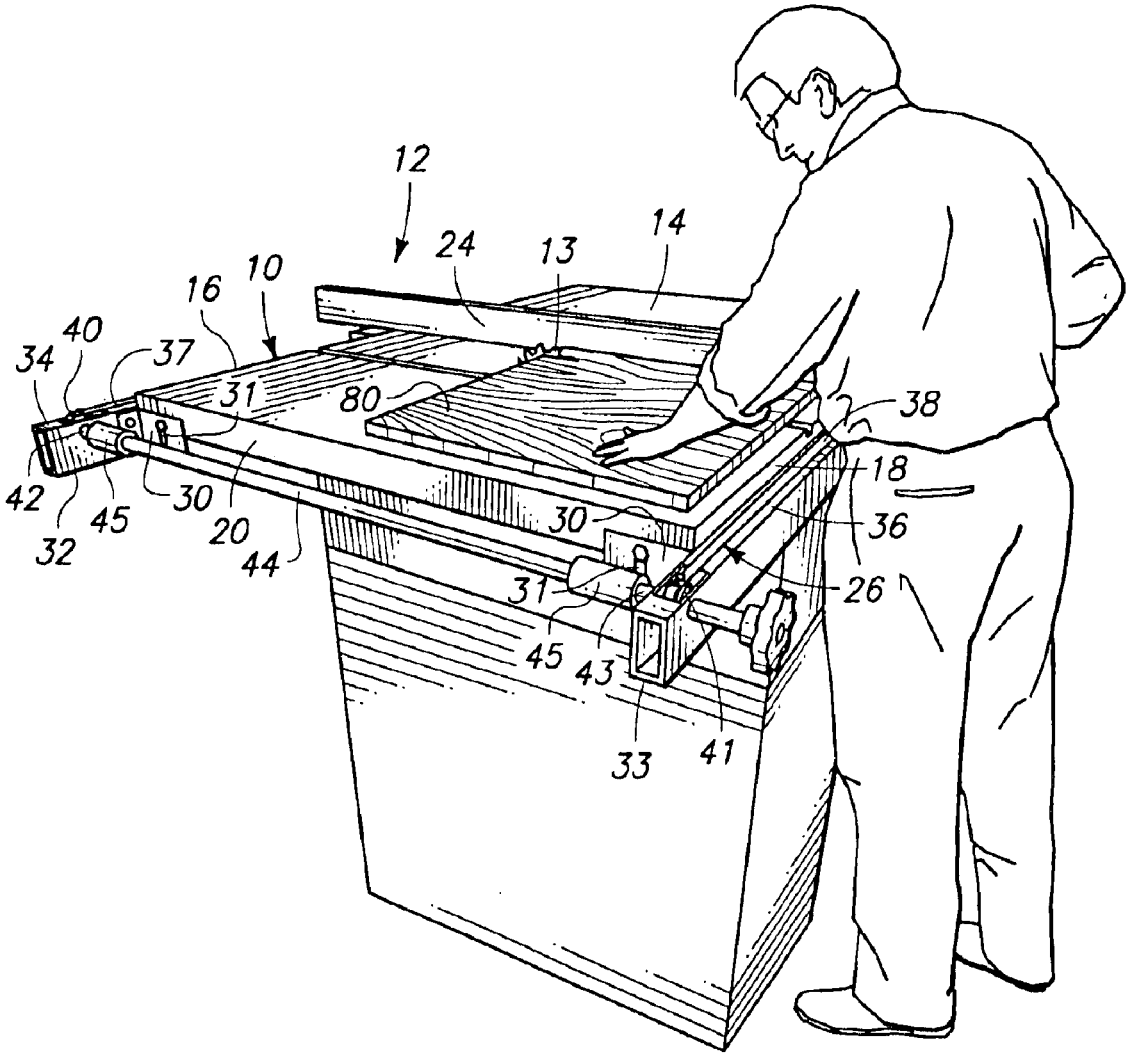
FIG. 1 is a perspective view of an operator and table saw with a preferred form of the present fence in operation thereon.

In general reference to FIG. 1 of the drawings, a cutting table is shown as identified by the reference numeral 10. The particular cutting table 10 exemplified is a table saw of the type commonly used in the woodworking industry. Other types of cutting tables may also be used with the present fence, which is generally shown at 12.

Figure 2:
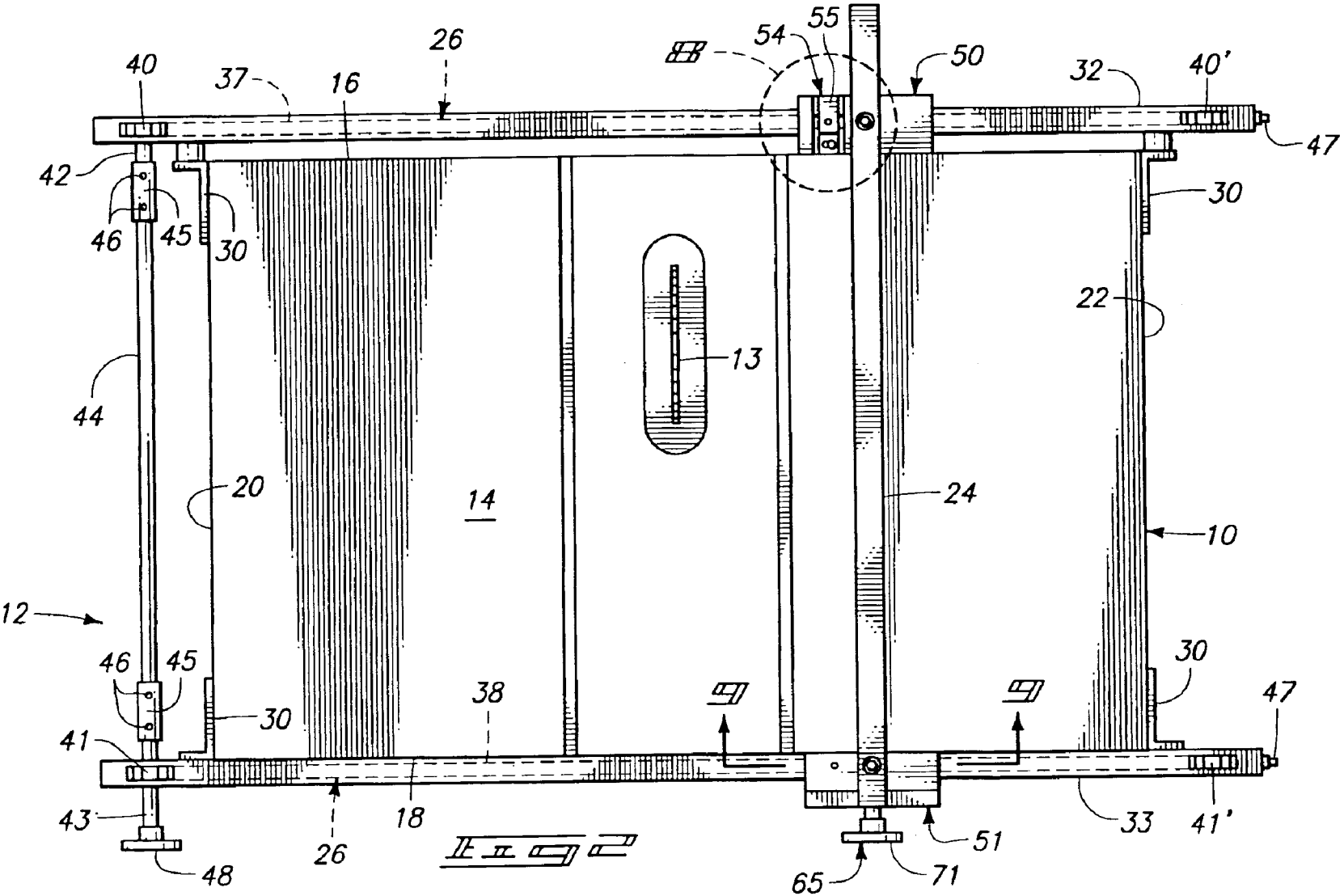
FIG. 2 is a top plan view of the preferred fence on a table saw.

The exemplary table 10 includes a table top with a substantially planar top surface 14 and substantially parallel forward and rearward side edges 16, 18. The size and configuration of the table top may vary according to the nature of the cutting device, but typically is rectangular and the edges 16, 18 are usually substantially parallel. The edges 16, 18 are joined by side edges 20, 22 that are also substantially parallel and perpendicular to the forward and rearward edges 16, 18 (FIG. 2).

Preferred forms of the present fence 12 are adapted to be mounted to existing cutting table tops, and may be produced as a retrofit for a variety of table forms and sizes. However, it is also possible for the present fence to be produced in combination with a cutting table.

In general terms, the preferred fence 12 includes an elongated cutting guide 24, ad motion conditioning members 26 configured for attachment to the cutting table 10. The motion conditioning members 26 are releasably connected by forward (FIG. 8) and rearward (FIG. 5) aligning lugs 28, 29 to the cutting guide 24 to permit substantially linear motion of the elongated cutting guide 24 while holding the cutting guide at a prescribed angular relation. The aligning lugs 28, 29 are configured to permit the elongated cutting guide 24 to be lifted upwardly from engagement with the motion conditioning members 26.

In preferred forms, the motion conditioning members 26 are configured for attachment to forward and rearward guide rails 32, 33 that are mountable by bracket assemblies 30 (FIGS. 1, 2) to the cutting table 10. The bracket assemblies 30 mount the guide rails 32, 33 to the table in such a manner that the guide rails 32, 33 are substantially parallel to one another and to the respective forward and rearward cutting table edges 16, 18.

The brackets 30 are preferably "L" shaped and may be provided with mounting slots and spacers that will enable secure mounting by means of standard bolt or bolt and nut combinations to various cutting tables. In the example illustrated, the brackets 30 are secured to the table side edges 20, 22. It is also possible that other bracket configurations and other mounting positions could be used to secure the guide rails 32, 33 in position in relation to the cutting table 10.

In a preferred form, the guide rails 32, 33 are comprised of elongated channel members, preferably formed of a rigid material such as steel or aluminum. The guide rails preferably extend at least the full length of the forward and rearward table edges 16, 18. The rails 32, 33 include respective forward and rearward elongated top guide surface 34, 36 that are positioned by the bracket assemblies 30 in parallel relation to and slightly below the top surface 14 of the cutting table 10.

Figure 9:
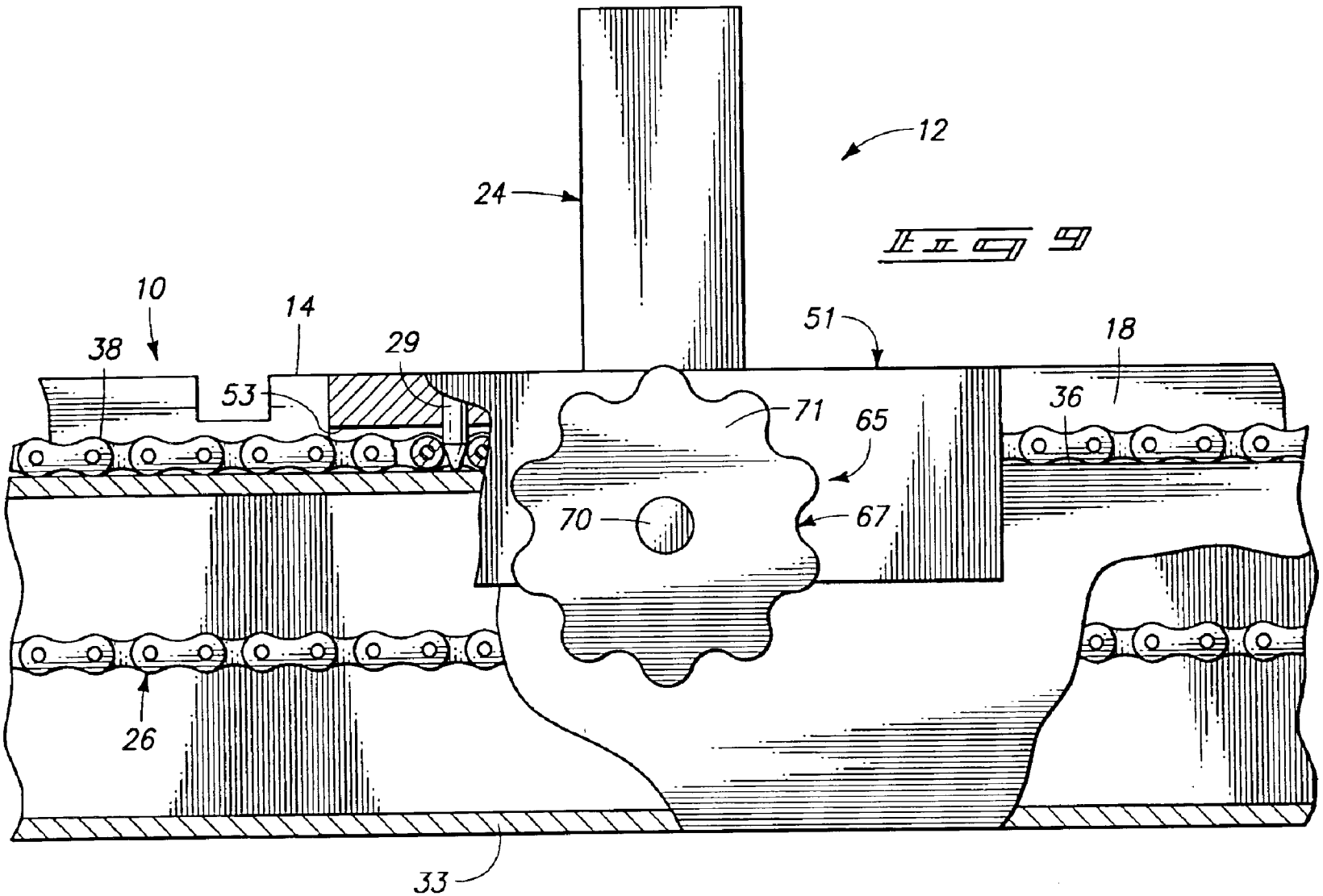
FIG. 9 is a fragmented detail view showing an aligning lug received between chain rollers.

A preferred example of the motion conditioning members 26 is shown as endless chains 37, 38 on respective guide rails 32, 33. The chains are trained about pairs of sprockets 40, 40' and 41, 41' that are rotatably mounted at ends of the respective guide rails 32, 33. The chains 37, 38 include working flights 39, 39' that extend along and are slidably supported on the guide rail surfaces 34, 36 (FIG. 9).

Chains 37, 38 are advantageously identical conventional roller-type chains with sprocket tooth receiving spaces between successive rollers. Such spaces are equally spaced apart in order to mate in driving connection with the teeth of the sprocket. The spaces are also used by the aligning lugs 28, 29 to releasably position the cutting guide 24 as will be understood from further description below.

Figure 7:
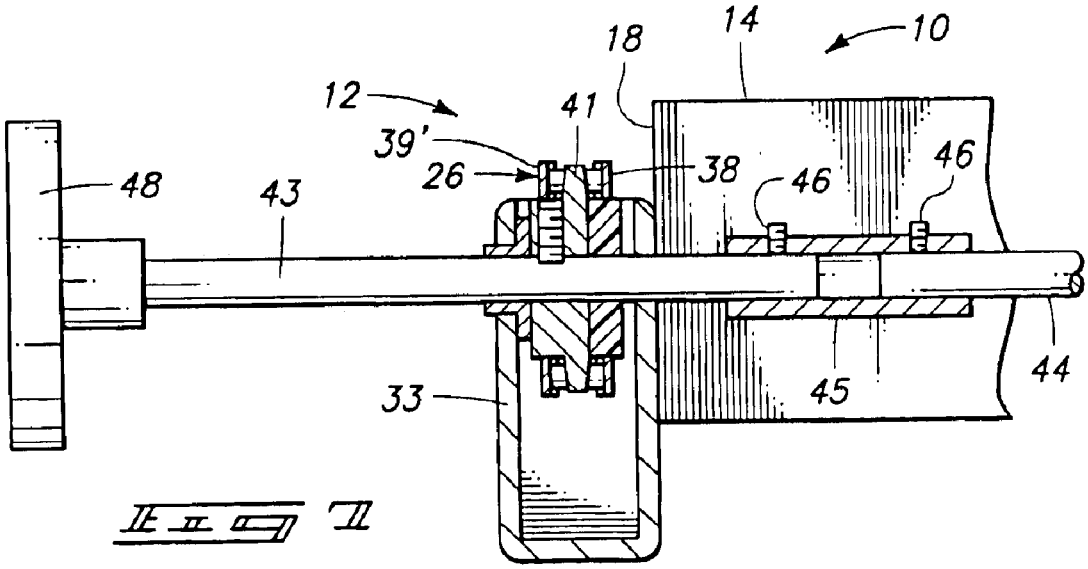
FIG. 7 is an enlarged fragmented sectional view taken substantially along line 7—7 in FIG. 3.

A shaft 44 (FIGS. 1, 2, 4 and 7) interconnects a stub shaft 42 that mounts one of the sprockets on one guide rail with another stub shaft 43 that mounts another one of the sprockets on the remaining guide rail. Sleeves 45 interconnect the stub shafts 42, 43 axially with the shaft 44. Set screws 46 (FIGS. 2, 7) operably lock the stub shafts 42, 43 to the shaft 44 so rotation of the shaft assembly will result in rotation of all the sprockets in unison, and corresponding identical movement of the chains 37, 38.

In preferred forms, the shaft assembly is extendible and adjustable to accommodate tables of different widths. To this end, the sleeves 45 are adjustably affixed to the shaft sections by set screws 46 to allow axial adjustment of the shaft assembly and rotational alignment of the sprockets. A cutting guide adjustment knob 48 is secured to the rearward end of one stub shaft 43, enabling a user to rotate the shaft and thereby move the chains and attached cutting guide 24 across the cutting table 10.

Figure 3:
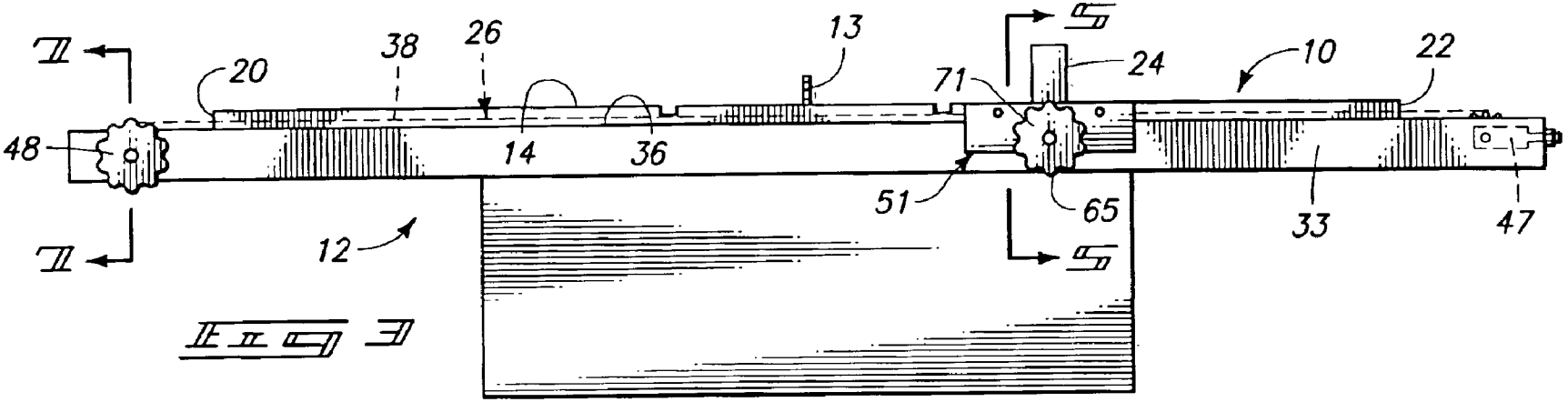
FIG. 3 is an end elevation view of the preferred fence on a table saw.
Figure 4:
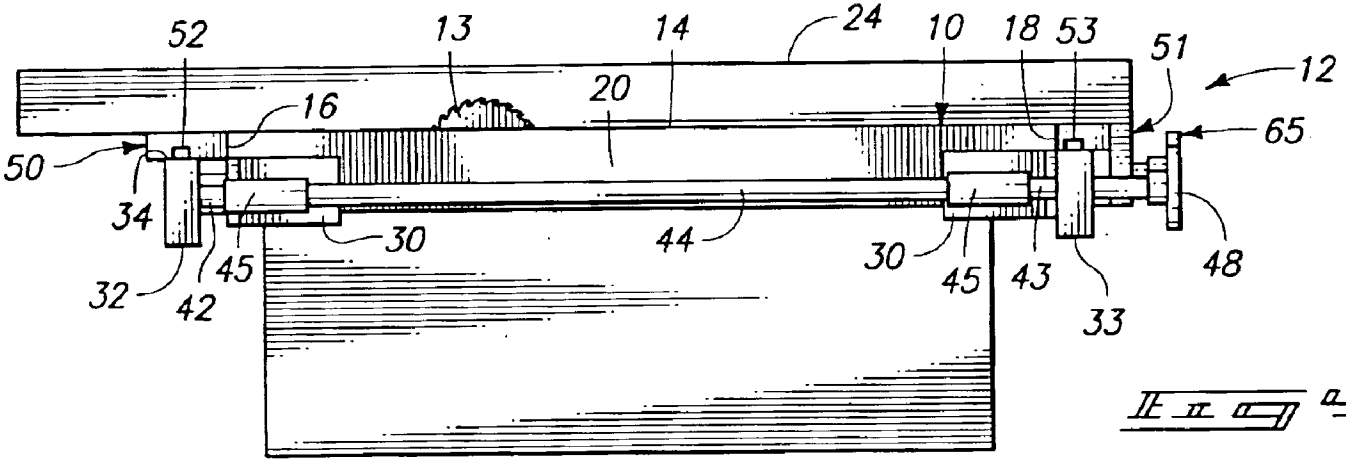
FIG. 4 is a side elevation view as viewed from the left in FIG. 3.

Chain tension may be selectively adjusted by chain tensioners 47 (FIGS. 2 and 3) which mount the two sprockets 40', 41' at ends of the guide rails that are opposite to the shaft attached sprockets. The tensioners 47 are preferably of a yoke and screw variety mounted within the guide rails, though other tensioner configurations could also be used.

The illustrated cutting guide 24 is preferably formed of an extruded aluminum channel, but could be any other appropriate material or construction suitable for use as a straight cutting guide. The guide is preferably longer than the width of the table (between forward and rearward edges 16, 18), and is mounted to forward and rearward base blocks 50, 51.

In preferred forms, the forward and rearward base blocks 50, 51 are mounted at opposed ends of the cutting guide 24. The blocks may be formed of billet machined aluminum, cast, or otherwise formed and attached adjacent opposite ends of the cutting guide by bolts or other appropriate fastening technology.

Base blocks 50, 51 preferably include chain receiving grooves 52, 53 respectively that fit over working flights of the chains 37, 38. The grooves 52, 53 are substantially parallel and oriented normal to the cutting guide to be received over the working flights of the chains. Bottom surfaces of the base blocks may slidably rest against top surfaces of the guide rails.

Figure 5:
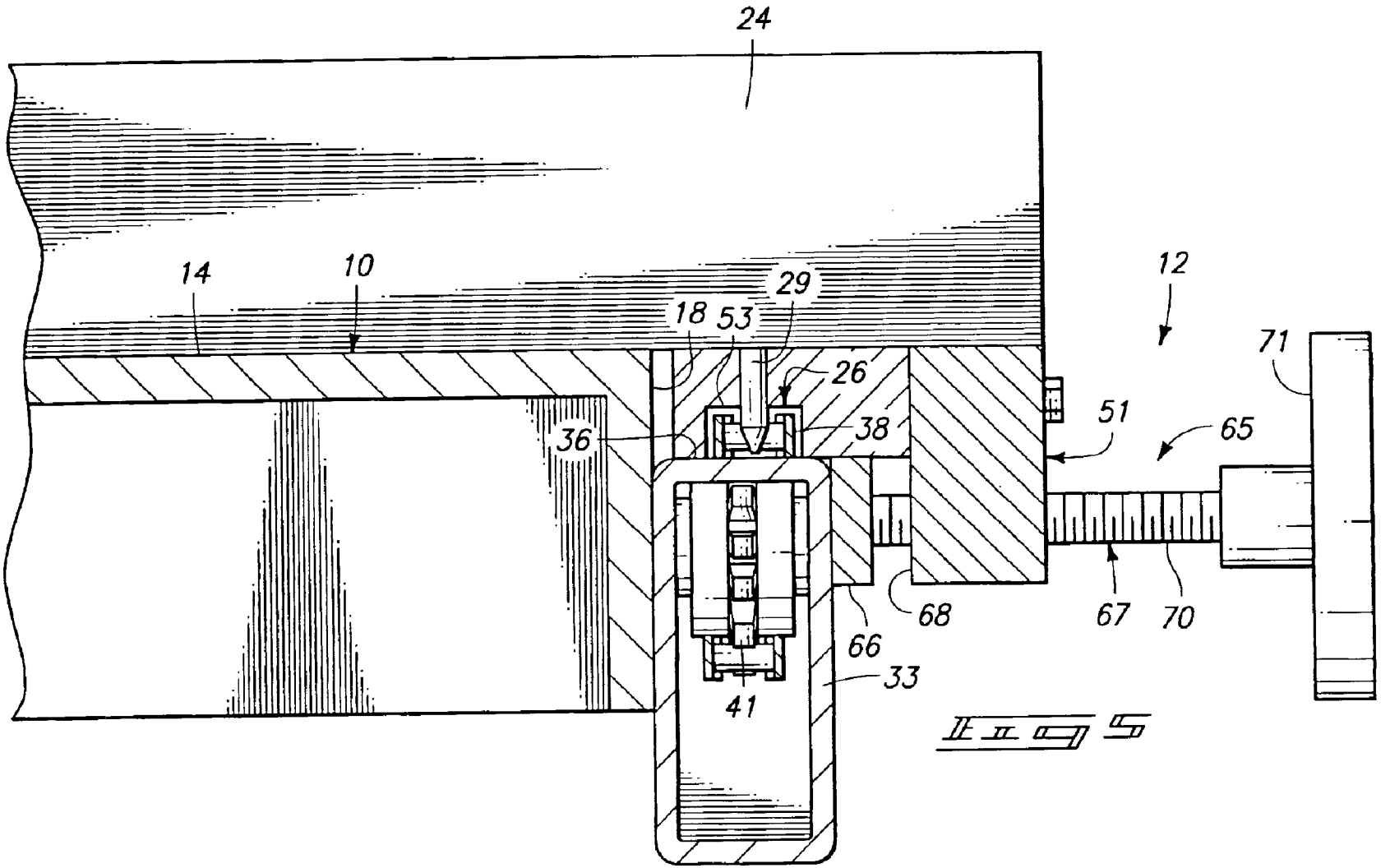
FIG. 5 is an enlarged fragmented sectional view taken substantially along line 5—5 in FIG. 3.

The aligning lugs 28, 29 are preferably secured to the respective base blocks 50, 51 within the chain receiving grooves 52, 53 and extend downwardly to be releasably received in the spaces between chain rollers (see FIGS. 5 and 9). In preferred forms, both aligning lugs 28, 29 are shaped as cylindrical pins, preferably of steel with pointed ends to facilitate insertion of the aligning lugs between chain rollers. The diameters of the aligning lugs are substantially equal to the spacing between adjacent chain rollers. Thus when the aligning lugs 28, 29 lowered into the spaces along the chains, the associated base blocks and cutting guide are releasably secured to the chain for movement across the cutting table. Further, the cutting guide, base blocks and aligning lugs can be easily lifted upwardly from engagement with the chains.

One of the aligning lugs, preferably the forward lug 28, is mounted by a lug adjustor 54 (FIGS. 2, 8) that is operatively connected between the cutting guide 24 and the one lug 28. The lug adjustor 54 is configured to adjustably position the one lug 28 laterally with respect to the cutting guide 24. Such lateral adjustment results in angular positioning of the cutting guide 24 when the lug is positioned in engagement with the associated chain 37.

Figure 8B:
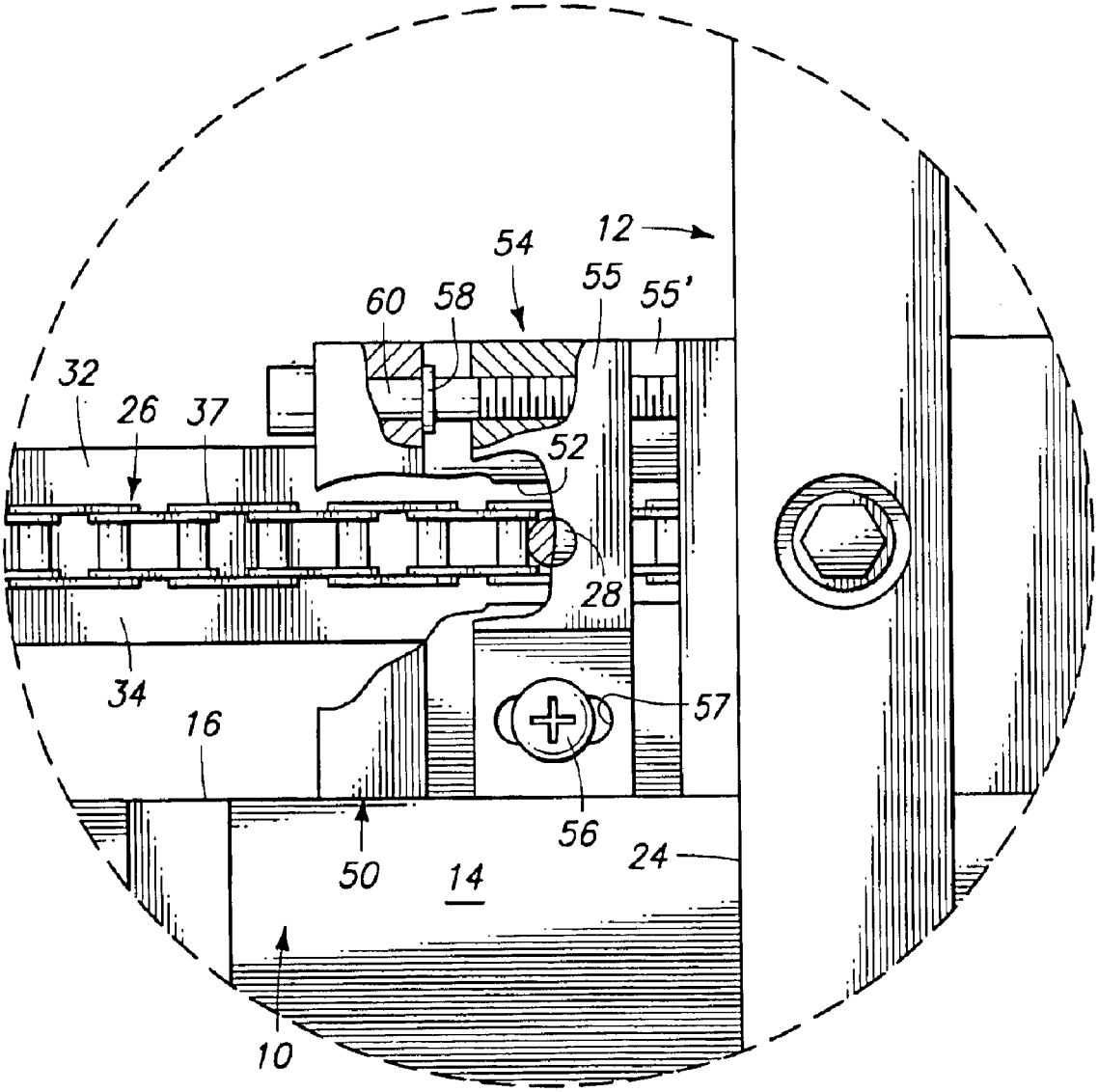
FIG. 8 is an enlarged fragmented detail plan view of a lug adjuster and associated components of the preferred fence.

In the illustrated example, and with specific reference to FIG. 8, the lug adjustor 54 is mounted to the forward base block 50. The exemplary adjustor 54 is comprised of a slide 55 movably mounted within a complimentary way 55' formed in the base block 50. An anchor screw 56 is received through a slot 57 in the slide 55 and threadably engages the base block 50. The anchor screw 56 may be loosened to allow the slide 55 to move translationally within the way 55' through a distance limited by the length of the slot 57.

The forward aligning lug 28 is rigidly attached to the slide 55 and projects downwardly into the chain receiving groove 52 of the base block 50. Any sliding movement of the slide 55 will thus result in corresponding movement of the aligning lug 28.

Fine angular alignment of the cutting guide is accomplished by turning a headed adjustment screw 60. The adjustment screw 60 extends through a portion of the base block 50 which is sandwiched between the screw head and an appropriate spring clip 58. The adjustment screw 60 is thus held by the screw head and spring clip 58 against axial movement. Threads on the adjustment screw 60 engage mating threads within the slide 55. Rotation of the adjustment screw will thus result in sliding movement of the slide 55 and the attached forward aligning lug 28. Such motion results in corresponding angular adjustment of the cutting guide 24.

A remaining one of the aligning lugs, preferably rearward aligning lug 29 is rigidly secured to one of the base blocks, preferably the rearward base block 51 (FIG. 9). Aligning lug 29 is fixed in position on the associated base block 51 and extends downwardly within the chain receiving groove where it may be releasably received within the adjacent spaces along the chain 38. Thus the aligning lug 29 is stationary relative to the cutting guide, and will act as a pivot point about which the cutting guide may be angularly adjusted in response to turning of the adjusting screw 60.

In preferred forms of the present fence 12, a locking mechanism 65 is provided in operable connection to the cutting guide 24. The locking mechanism 65 in general is configured to secure the cutting guide in a selected position along the table 10.

Figure 6:
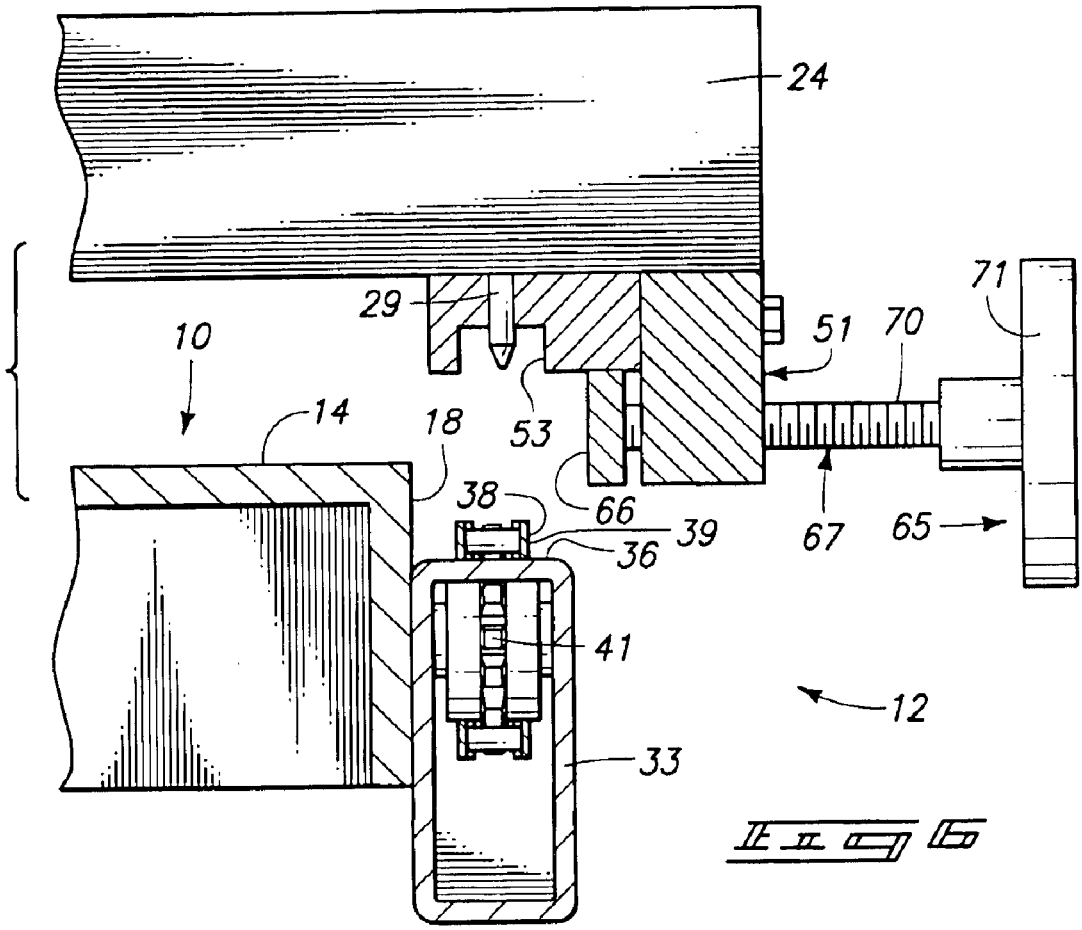
FIG. 6 is a view similar to FIG. 5 only showing the cutting guide lifted clear of remaining mechanism and table saw.

The preferred locking mechanism exemplified herein includes a clamp bar 66 (FIGS. 5, 6) mounted to one of the base blocks (preferably the rearward base block 51) by a tightener 67 that is configured to clamp the remaining base block (preferably the forward base block 50) to an adjacent side edge of the table 10.

More specifically, the clamp bar 66 is mounted at an end of a jack screw 70. The jack screw end is journalled in the clamp bar 66 and the clamp bar slides in a guideway 68 formed in the base block 51 in such a manner that rotation of the jack screw 70 will not result in corresponding rotational motion of the clamp bar. However, the threads of the jack screw engage mating threads formed in the rearward base block 51, so that rotation of the jack screw 70 will result in forward or rearward motion of the clamp bar.

A knob 71 is provided to enable manual rotation of the jack screw. The knob 71 may thus be turned to move the clamp bar 66 against the rearward guide rail 33. This action pulls the forward base block 50 (FIG. 4) against the forward edge 16 of the table 10, thereby securely clamping the cutting guide in position relative to the table.

The above clamping action will cause the chains, especially the forward chain 37 to shift slightly toward the forward edge 16 of the table. This shifting motion is accommodated by allowing a limited amount of axial "play" of the sprockets within the guide rails 32, 33 so the chains need not bend during the clamping action.

It is pointed out that the locking mechanism described above may take other forms. For example, known forms of cam type locking mechanisms (not shown) may be provided in place of the jack screw and knob arrangement described above.

Given the above technical description, installation and operation of the presently preferred fence 12 may be readily understood.

The present fence 12 may be supplied in four basic components: the cutting guide 24 (with the base blocks 50, 51 and associated elements mounted thereon); the forward guide rail 32 (with brackets 30, forward chain 37 and sprockets 40, 40' mounted thereon); the rearward guide rail 33 (with the remaining brackets 30, rearward chain 38 and sprockets 41, 41' mounted thereon); and the shaft 44 (with the sleeves 45 mounted thereon).

Given the above components, the fence 12 may be mounted to a table 10 by simply bolting the brackets 30 to the appropriate table sides. Many conventional table saws include mounting holes in the table sides that can be used in this procedure. If such holes are not provided, an ordinary drill may be used to form mounting holes.

Appropriate slots 31 (FIG. 1) in the mounting brackets 30 will allow elevational positioning of the guide rails 32, 33. This may be done with the cutting guide 24 resting on the table top surface 14 and with the base blocks 50, 51 overhanging the front and rearward table edges 16, 18. The rails 32, 33 are adjusted elevationally (with the brackets 30 loosely mounted) until the bottom surfaces of the base blocks 50, 51 just touch the respective top guide surfaces 34, 36 and the aligning lugs 28, 29 are received within adjacent spaces between rollers of the chains 37, 38. When proper elevational adjustment is achieved, the bolts securing the brackets 30 to the table are tightened.

Now the shaft 44 may be mounted. This is done by sliding the sleeves 45 inwardly from the shaft ends to allow positioning of the shaft in axial alignment with the stub shafts 42, 43. The sleeves 45 are then slid outwardly to overlap and receive ends of the respective stub shafts. All but one of the set screws 46 are then tightened. The one remaining set screw 46 is left loose to facilitate alignment of the cutting guide.

Cutting guide alignment may be achieved by first lowering the cutting guide onto the table. As this is done, the aligning lugs 28, 29 will slip downwardly into position within spaces between rollers of the chains 37, 38. Now the cutting guide 24 is pushed across the table until it touches and shifts into flush abutment with the cutting blade 13. The cutting guide 24 is now parallel with the cutting blade 13 and the final set screw 46 may be tightened, thereby locking all the sprockets and chains in precise relation. Rotation of the cutting guide adjusting knob 48 will now result in corresponding rotation of all sprockets, and uniform, in unison movement of the chains 37, 38. The chains 37, 38 move the cutting guide 24 across the table 10, all the while maintaining the cutting guide 24 in the set, precise parallel relation to the cutting blade 13.

If further precision positioning of the cutting guide is desired, the adjustment screw 60 may be used to shift the forward end of the cutting guide 24 to the desired angular position. Such fine adjustment is best accomplished using appropriate fine measuring tools such as a conventional dial indicator for further precision adjustment of the cutting guide. The present fence 12 is now ready for use.

In describing use, it will be assumed that a 3 inch cut is to be made on a workpiece 80 as shown in FIG. 1. To set the fence, the user simply turns the adjusting knob 48 driving the chains to move the cutting guide to a point 3 inches away from the cutting blade 13. Any appropriate measuring device may be used to assure proper positioning. Alternatively, a scale (not shown) of conventional nature may be mounted to the rearward guide rail 33 for this purpose.

Once the proper cutting guide position is selected, the locking jack screw knob 71 may be tightened to lock the cutting guide in position. As the knob 71 is turned, the clamp bar 66 will move against the rearward guide rail 33 and pull the forward base block 50 firmly against the forward edge 16 of the cutting table, thus locking the cutting guide in position, with the chains holding the guide in the set alignment. The cut may now be made.

If use of the cutting table is desired without the fence 12, the cutting guide 24 may simply be lifted from the table. The aligning lugs 28, 29 will slip upwardly from engagement with the chains 37, 38 as the cutting guide is lifted. Now the table 10 is free and unobstructed.

When it is again desired to re-mount the cutting guide to the table, the user simply lowers the guide onto the table. The aligning lugs 28, 29 will slide into whatever chain spaces are immediately below, and the precise previously set angular adjustment is again established. This relationship will be maintained regardless of where the cutting guide is positioned on the table, and use can begin immediately as described above.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A cutting apparatus comprising:

a cutting table having a work support surface, and a cutting tool at least proximate to the work support surface for cutting a workpiece on the work support surface;

a pair of elongated guide rails mounted to the cutting table;

a chain on each guide rail;

a pair of sprockets rotatably mounted on each guide rail with each pair of sprockets mounting one of said chains;

each chain including sprocket tooth receiving spaces and a working flight extending along the associated guide rail;

a shaft interconnecting one of the sprockets on one guide rail with one of the sprockets on the remaining guide rail;

an elongated cutting guide extending across the work support surface; and aligning lugs interconnecting the cutting guide and the working flights and oriented substantially normal to the working flights, each of the aligning lugs projecting from one of the cutting guide and the corresponding working flight and being slidably received in the other of the corresponding working flight and the cutting guide, respectively, for connecting the cutting guide to the chains to transmit motion to the cutting guide along the guide rails responsive to movement of the chains along the guide rails, the slidable connection of the aligning lugs permitting disconnection of the cutting guide from the chains by lifting the cutting guide in a direction substantially normal to the working flights.

2. A fence for a cutting table as defined by claim 1, further comprising:

a locking mechanism operatively connected to the cutting guide to secure the cutting guide in a selected position along the guide rails.

3. A fence for a cutting table as defined by claim 1, further comprising:

a lug adjustor operatively connected with the cutting guide and one of the aligning lugs to adjustably position the one aligning lug laterally with respect to the cutting guide.

4. A fence for a cutting table as defined by claim 1, wherein the shaft is comprised of:

an extendible drive shaft secured to the one sprocket and said another one of the sprockets.

5. A fence for a cutting table as defined by claim 1, wherein the chains are roller chains; and wherein the aligning lugs are mounted to the cutting guide to be releasably received between links of said roller chains.

6. The cutting apparatus as defined by claim 5 wherein the aligning lugs comprise vertically oriented cylindrical pins.

7. The cutting apparatus as defined by claim 6 wherein the cylindrical pins comprise pointed ends.

8. The cutting apparatus as defined by claim 1, further comprising base blocks mounted at opposed ends of the cutting guide; and wherein the aligning lugs are mounted to the base blocks.

9. The cutting apparatus as defined by claim 8 wherein the aligning lugs comprise vertically oriented cylindrical pins.

10. The cutting apparatus as defined by claim 9 wherein the cylindrical pins comprise pointed ends.

11. The cutting apparatus as defined by claim 1, further comprising base blocks mounted at opposed ends of the cutting guide;

wherein each base block includes a chain receiving groove formed therein; and wherein the aligning lugs are mounted to the base blocks within the chain receiving grooves.

12. The cutting apparatus as defined by claim 11 wherein the aligning lugs comprise vertically oriented cylindrical pins.

13. The cutting apparatus as defined by claim 12 wherein the cylindrical pins comprise pointed ends.

14. The cutting apparatus as defined by claim 1, further comprising:

base blocks mounted at opposed ends of the cutting guide; each base block including a chain receiving groove formed therein;

wherein the aligning lugs are situated within the chain receiving grooves;

a lug adjustor on one of the base blocks, mounting one of the aligning lugs and configured to adjust the one aligning lug laterally with respect to the cutting guide.

15. The cutting apparatus as defined by claim 14 wherein the aligning lugs comprise vertically oriented cylindrical pins.

16. The cutting apparatus as defined by claim 15 wherein the cylindrical pins comprise pointed ends.

17. The cutting apparatus as defined by claim 1, further comprising base blocks mounted at opposed ends of the cutting guide; and a lug adjuster on one of the base blocks, mounting one of the aligning lugs and configured to selectively shift the one aligning lug laterally with respect to the cutting guide.

18. The cutting apparatus as defined by claim 17 wherein the aligning lugs comprise vertically oriented cylindrical pins.

19. The cutting apparatus as defined by claim 18 wherein the cylindrical pins comprise pointed ends.

20. The cutting apparatus as defined by claim 1 wherein the aligning lugs comprise vertically oriented cylindrical pins.

21. The cutting apparatus as defined by claim 20 wherein the cylindrical pins comprise pointed ends.

* * * * *

UNITED STATES PATENT AND TRADEMARK OFFICE

CERTIFICATE OF CORRECTION

PATENT NO. : 6,851,345 B1
DATED : February 8, 2005
INVENTOR(S) : John P. Kennelly et al.

It is certified that error appears in the above-identified patent and that said Letters Patent is hereby corrected as shown below:

Column 7,
Line 49, replace "A fence for a cutting table as defined by claim 1, further" with -- The cutting apparatus as defined by claim 1, further --
Line 54, replace "A fence for a cutting table as defined by claim 1, further" with -- The cutting apparatus as defined by claim 1, further --
Line 60, replace "A fence for a cutting table as defined by claim 1," with -- The cutting apparatus as defined by claim 1, --

Column 8,
Line 1, replace "A fence for a cutting table as defined by claim 1," with -- The cutting apparatus as defined by claim 1, --

Signed and Sealed this

Seventeenth Day of May, 2005

JON W. DUDAS
*Director of the United States Patent and Trademark Office*